US005542197A

United States Patent [19]

Vincent

[11] Patent Number: 5,542,197

[45] Date of Patent: Aug. 6, 1996

[54] SNOWSHOE WITH ADJUSTABLE DECKING TENSION

[76] Inventor: Maurice Vincent, 410, rue Thomas Martin village, Huron (Québec), Canada, G0V 4V0

[21] Appl. No.: 462,943

[22] Filed: Jun. 5, 1995

[51] Int. Cl.[6] ..... A43B 5/04; A43B 5/16

[52] U.S. Cl. ..... 36/122; 36/125

[58] Field of Search ..... 36/122, 123, 124, 36/125

[56] References Cited

U.S. PATENT DOCUMENTS

| | | | |
|---|---|---|---|
| 982,053 | 1/1911 | Haefer | 36/125 |
| 1,407,645 | 2/1922 | Drew | 36/124 |
| 2,619,742 | 12/1952 | Cumming | 36/125 |
| 2,821,031 | 1/1958 | Howe | 36/125 |
| 2,947,094 | 8/1960 | Gabry | 36/4.5 |
| 2,987,834 | 1/1959 | Howe | 36/4.5 |
| 3,060,600 | 10/1962 | Howe | 36/125 |
| 3,596,374 | 8/1971 | Covington | 36/4.5 |
| 3,599,352 | 8/1971 | Novak | 36/123 |
| 3,636,643 | 1/1972 | Lundquist | 36/4.5 X |
| 3,638,333 | 2/1972 | Sprandel | 36/4.5 |
| 3,744,162 | 7/1973 | Beck | 36/125 |
| 3,755,926 | 9/1973 | Schonbrun | 36/125 |
| 3,885,327 | 5/1975 | Maki | 36/125 |
| 3,992,790 | 11/1976 | Frye | 36/125 |
| 4,085,529 | 4/1978 | Merrifield | 36/125 |
| 4,259,793 | 4/1981 | Morgan, Jr. et al. | 36/125 |
| 4,271,609 | 6/1981 | Merrifield | 36/125 |
| 4,348,824 | 9/1982 | Treadwell | 36/125 |
| 4,720,928 | 1/1988 | Faber et al. | 36/122 |
| 5,253,437 | 10/1993 | Klebahn et al. | 36/125 X |
| 5,259,128 | 11/1993 | Howell | 36/122 |

FOREIGN PATENT DOCUMENTS

| | | | |
|---|---|---|---|
| 0961729 | 9/1982 | U.S.S.R. | 36/122 |

*Primary Examiner*—Paul T. Sewell
*Assistant Examiner*—BethAnne C. Dayoan

[57] ABSTRACT

The snowshoe having a tubular, elongated, open, main frame, a flexible sheet decking extending over the main frame and defining a peripheral edge section anchored to the main frame, and a telescopic cross-bar, extending transversely of the main frame intermediately thereof. The cross-bar releasably biases the elongated main frame in such a way as to vary its overall width, whereby the widthwise tensioning of the flexible sheet decking is concurrently varied. The sheet decking receives and supports a wearer's foot harness assembly, located directly above the cross-bar.

7 Claims, 5 Drawing Sheets

SNOWSHOE WITH ADJUSTABLE DECKING TENSION

FIELD OF THE INVENTION

This invention relates to snowshoes, and particularly to snowshoes having adjustable means for facilitating walking over graded or deep snow ground terrain.

BACKGROUND OF THE INVENTION

U. S. Pat. No. 4,085,529 issued Apr. 25, 1978 to Fred MERRIFIELD, discloses a snowshoe having a tubular open frame carrying a fabric decking, separated in two spaced apart toe and heel decking sections. The deckings are attached to the frame by a plurality of closed loop tie members. A fixed length cross-bar member is positioned between the toe and heel deckings, and is rigidly affixed transversely to the side portions of the frame by collar clamps. The cross-member is adjustable in its fore and aft location relative to the main frame, in the gap between the two decking portions, thus allowing the wearer to adjust the length of the snowshoe forward of the binding location.

OBJECT OF THE INVENTION

The main object of the invention is to provide a snowshoe that will have means for adjusting the tensioning of the decking in accordance with the density of ground snow and with the slope gradient of the ground terrain.

SUMMARY OF THE INVENTION

In accordance with the object of the invention, there is disclosed a snowshoe comprising: (a) a semi-rigid, open, main frame, defining a main inner open area; (b) a flexible sheet decking, extending over said open frame main inner open area, and defining a peripheral edge section; (c) means for attaching the peripheral edge section of said sheet decking to said main frame; and (d) means for adjustably varying the tensioning of said flexible sheet decking; whereby said sheet decking is adapted to receive and support a wearer's foot.

Preferably, said tension adjusting means includes an elongated telescopic member, extending through said main open area and connected at opposite ends to said main frame, wherein said telescopic member adjustably deforms the shape of said flexible sheet decking whereby variations in tensioning thereof follows.

The open frame could consist of a tubular member, disposed in an ovoidal closed loop fashion; and said adjustment means would then include:—a rigid elongated cross-bar member, extending transversely of said main open area at an intermediate section of said main frame;—means for mounting each end portion of the cross-bar member to transversely opposite sections of said frame tubular member; and—telescopic means for varying the length of said cross-bar member, The frame tubular member could also include two generally U-shape half-sections, and a pair of first and second tubular connector members releasably interconnecting the outer ends of each pair of coaxially registering legs of said two half-sections of the frame tubular member; said mounting means including a radial cavity in said first connector member, being fully engaged by a first end portion of said cross-bar member, and a radial channel in said second connector member, being at least partially engaged by a second end portion of said cross-bar member. Preferably, said telescopic means includes the provision of inner threads, made into said second connector member radial channel, outer threads, made in said second end portion of the cross-bar member, and a nut member, threadingly carried by the threaded portion of said cross-bar member intermediately of said first and second connector members; whereby unscrewing action unto said nut member against the registering tubular section of said open frame spreads apart the opposite intermediate tubular sections of said open frame and increases the width of said open frame, thus tightening the tensioning of said sheet decking.

The sheet decking may be made from neoprene.

It is envisioned to add a harness assembly, having a rigid base part and a flexible strap part, and hook members pivotally interconnecting said rigid base part to said rigid cross-bar member for pitch motion control of the wearer, said rigid base part for containing the toe portion of the wearer's foot and said strap part for attachment to the wearer's ankle portion. A large aperture is preferably made into said sheet decking ahead of said harness base part and sized for free partial through-engagement by said harness base part and associated wearer's foot, and a rigid gripper member, carried transversely of said harness base part, said gripper member defining a serrated edge for forcible engagement into frozen ground terrain upon forward pitch motion of said harness base part.

Advantageously, each said tubular connector member includes an intermediate diametrally enlarged section, into which the radial cavity and the radial channel are respectively lodged, and two opposite tubular segments, each tubular segment having an intermediate annular groove, a sealing O-ring being lodged into each said groove, each said O-ring frictionally engaging with the interior face of the corresponding tubular leg of the open frame in fluid-tight fashion.

Preferably, said peripheral attachment means consists of a number of discrete ear loop members, integrally carried at the peripheral edge portion of said sheet decking and anchored to the main tubular frame by bolt members, successive said ear loop members being spaced from each other.

DETAILED DESCRIPTION OF THE DRAWINGS

Figure 1:
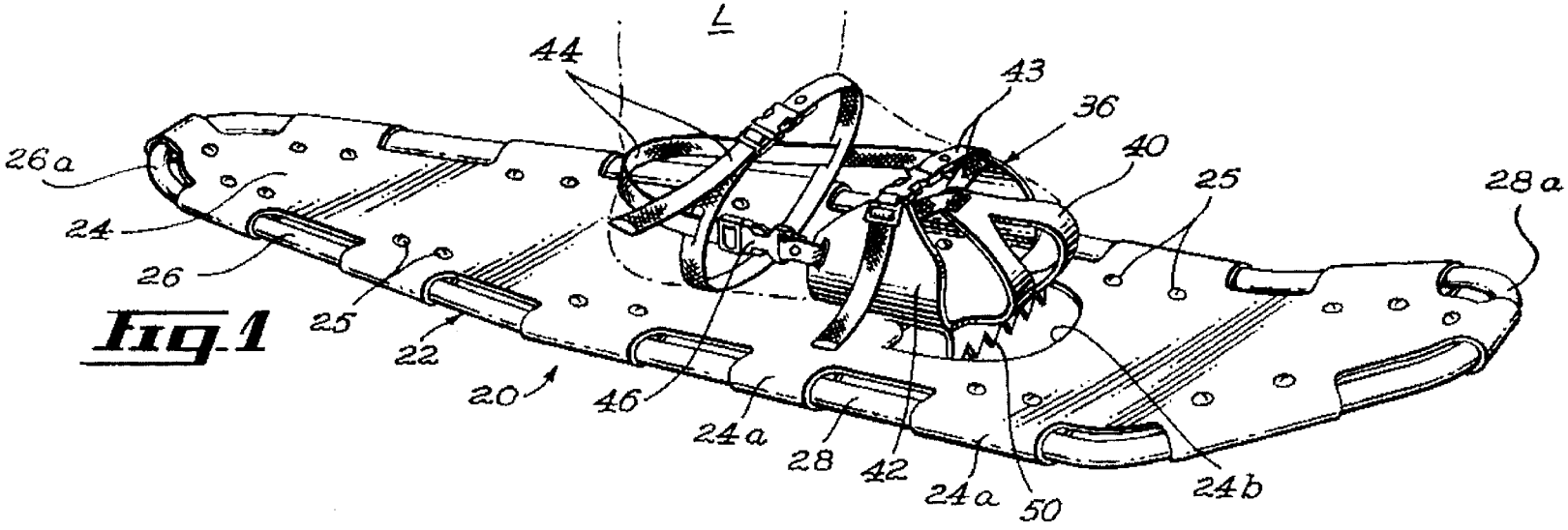
FIG. 1 is an isometric view of a snowshoe according to a preferred embodiment of the invention, with the foot of a wearer (shown in phantom lines) being engaged into the snowshoe harness assembly.
Figure 4:
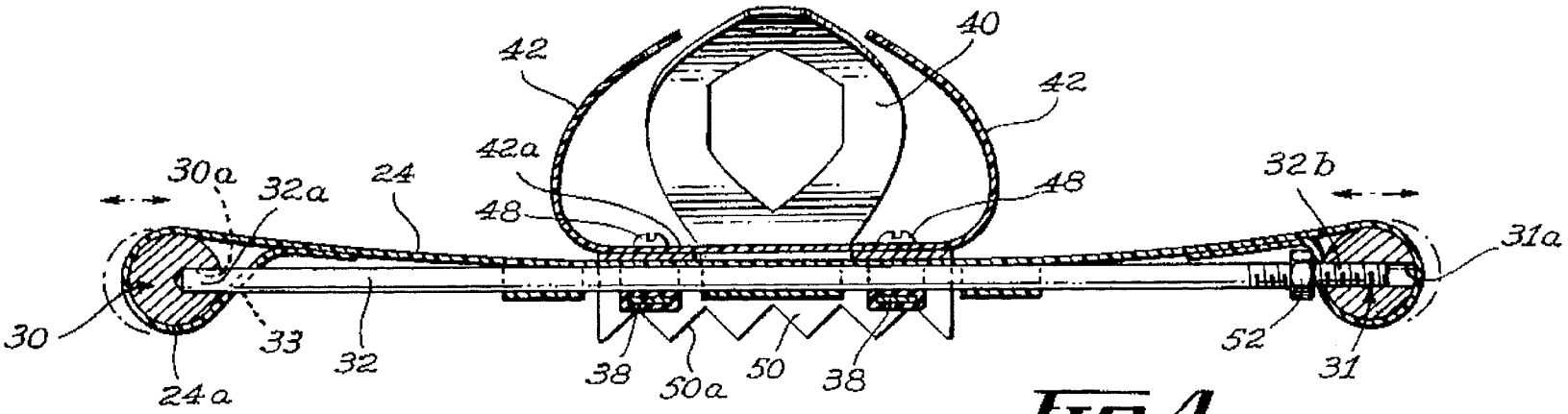
FIG. 4 is a cross-sectional view, at an enlarged scale, of the snowshoe, taken along line IV—IV of FIG. 2, and suggesting by the arrows how the cross-bar length and the snowshoe frame width cab be concurrently adjusted.
Figure 2:
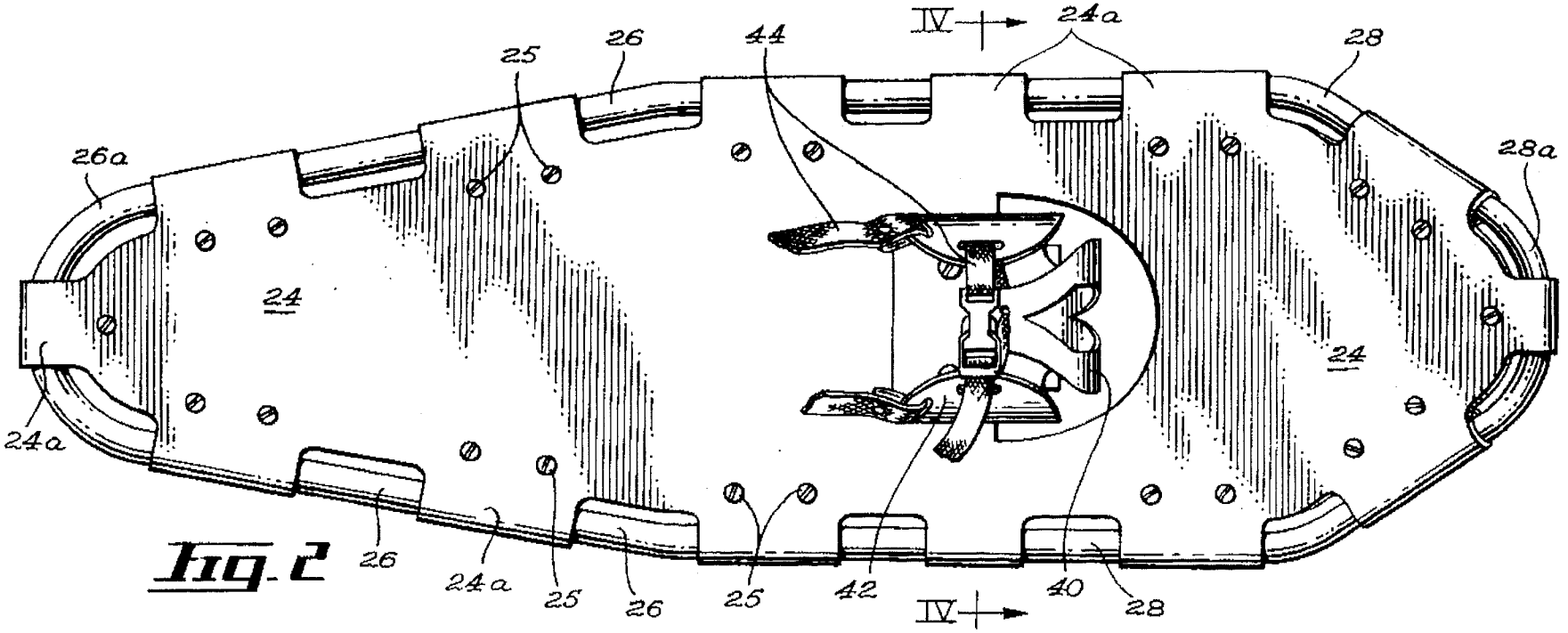
FIG. 2 is a top plan view of the snowshoe of FIG. 1.
Figure 3:
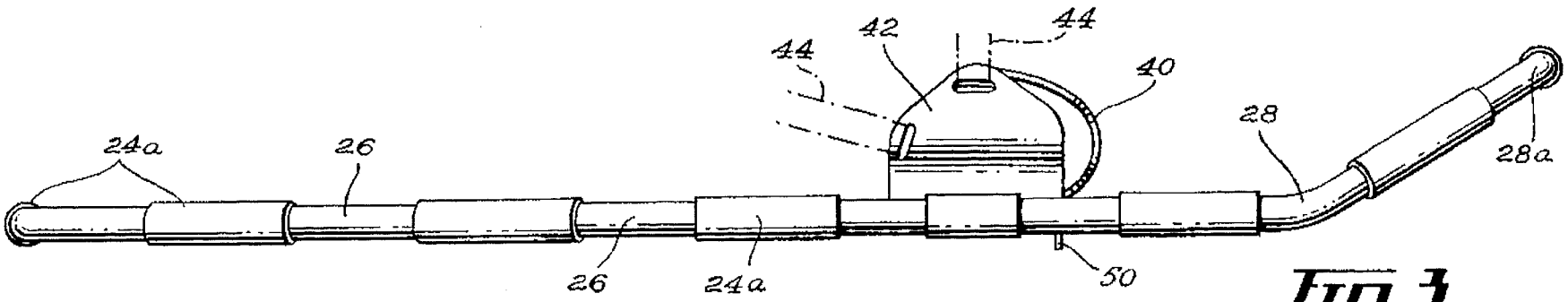
FIG. 3 is a lateral side edge view of said snowshoe, showing part of the harness straps in phantom lines.
Figure 5:
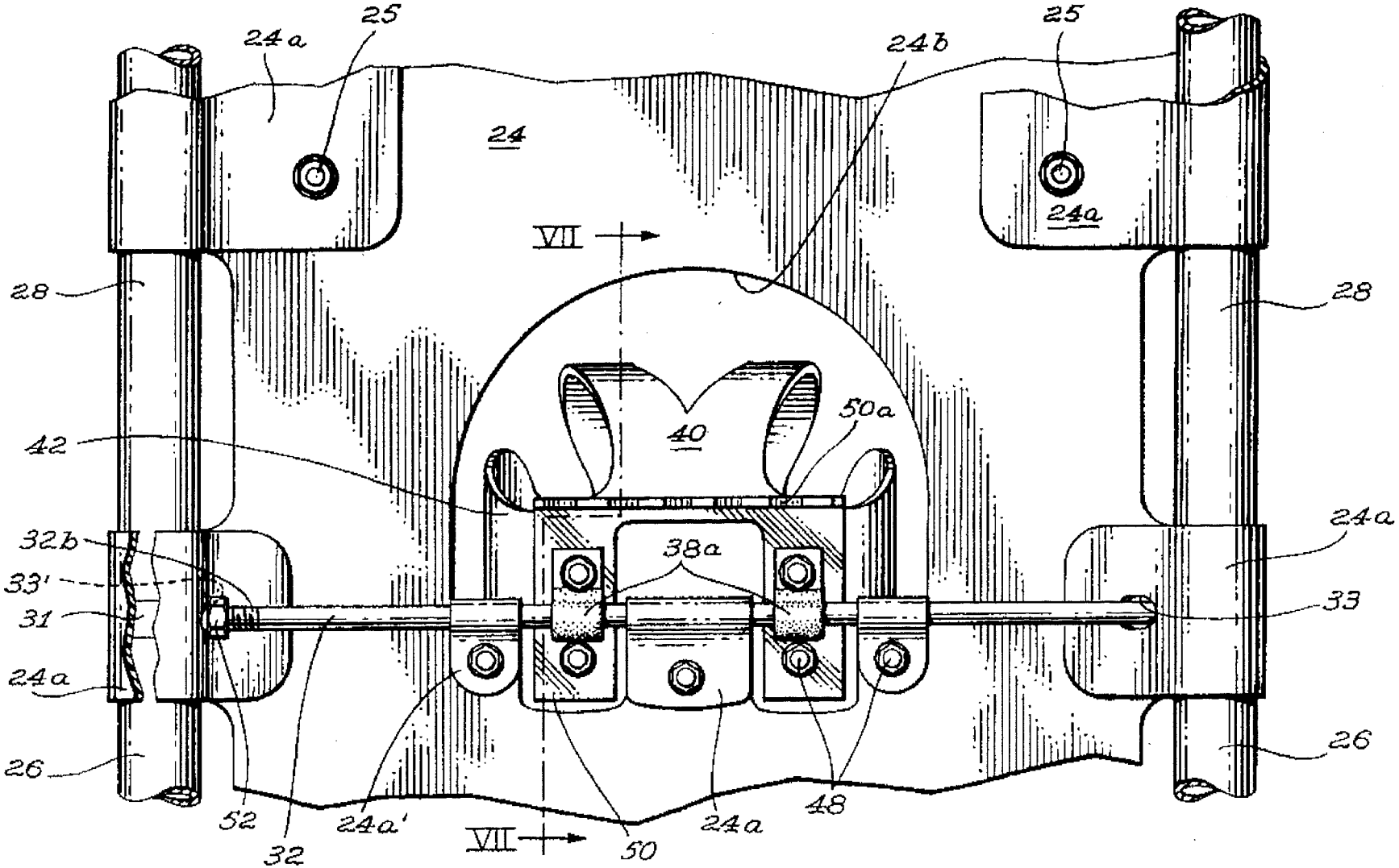
FIG. 5 is a partly broken bottom plan view of the harness area of said snowshoe, at an enlarged scale relative to that of FIG. 2.
Figure 9:
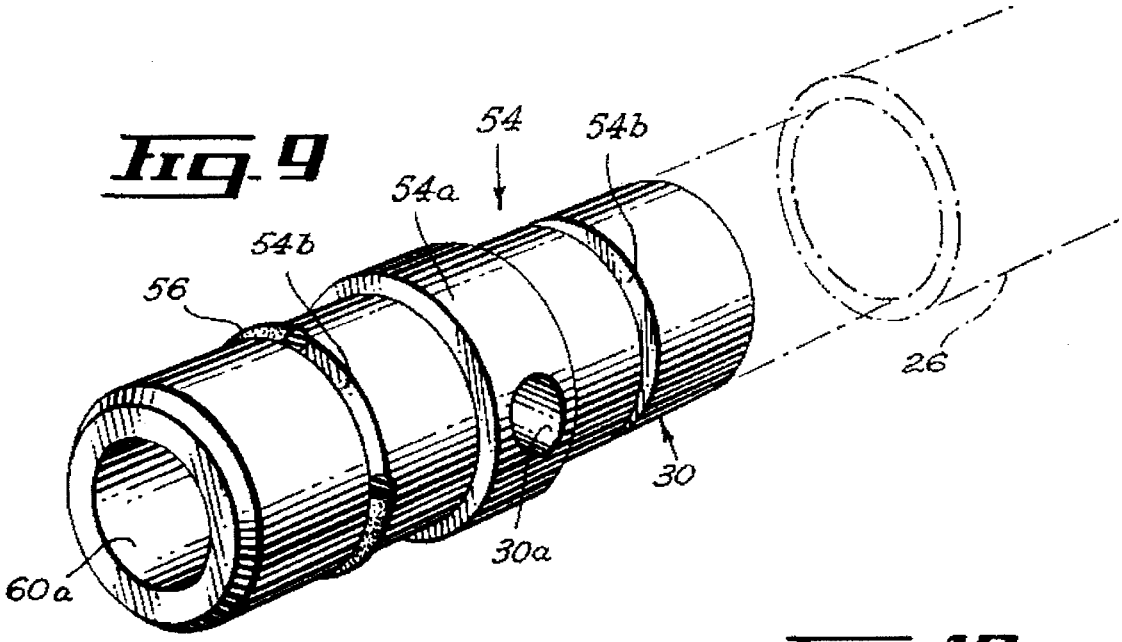
FIG. 9 is a perspective view of one of the connector plugs that interconnect the half portions of the snowshoe frame, and showing in dashed outline the end tube from a tubular half portion of the main frame.
Figure 10:
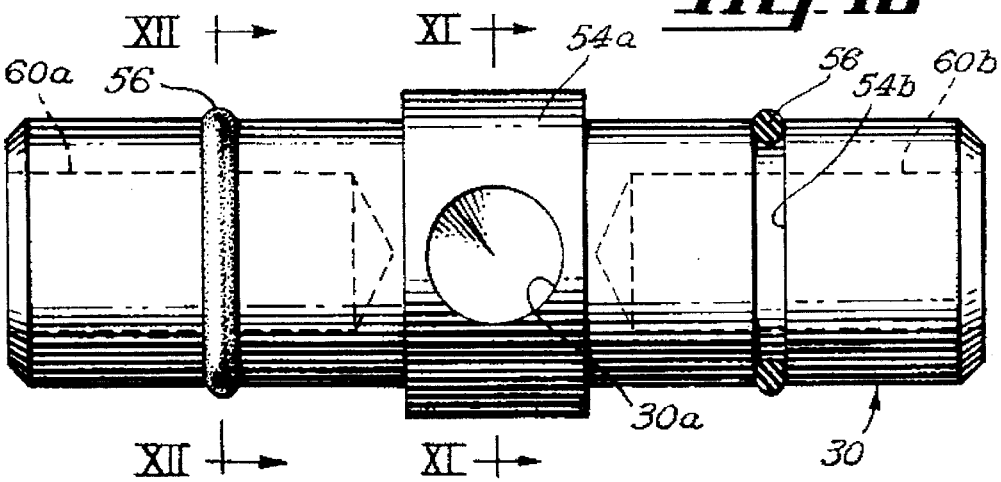
FIG. 10 is a plan view of this connector plug, showing the ends of two coaxial tubes from the main frame two half portions.
Figure 11:
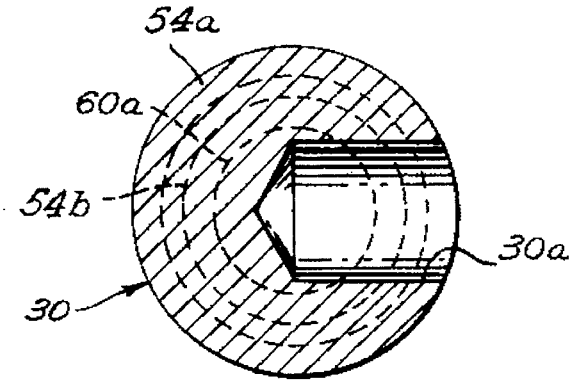
FIGS. 11 and 12 are cross-sectional views of the connector plug, taken along lines 11—11 and 12—12 respectively of FIG. 10.
Figure 12:
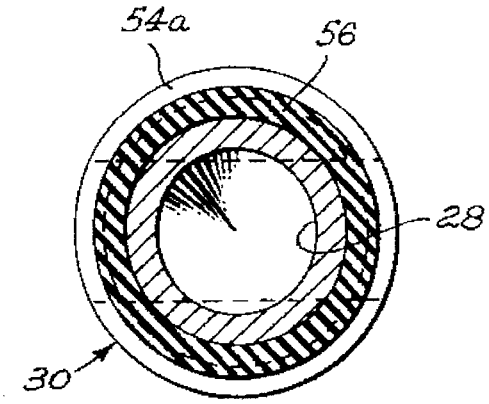

As illustrated in FIGS. 1–2, snowshoe 20 includes an elongated peripheral tubular frame 22 supporting a flexible sheet decking 24. Open frame 22 consists of two tubular half-portions 26 and 28, each of generally U-shape, with the two frame half-portions 26 and 28 being endwisely interconnected by a pair of tubular connector plugs 30, 31 (FIGS. 4 and 9–10). The two laterally opposite connector plugs 30, 31, are interconnected by a cross-bar 32, located intermediately of the rounded webs 26*a* and 28*a* of U-tubes 26 and 28. Cross-bar 32 includes adjustment means 34, detailed later, for adjusting its length, whereby the overall width of the snowshoe main frame 22 can be adjustably varied.

The flexible sheet decking 24 is preferably made from an elastomeric material, e.g. neoprene ( a trademark), which is made from a lacing of nylon strings covered by a layer of rubber. Neoprene is preferred because, due to its elastomeric surface, the snowshoe will have a greater traction on snow when the wearer engages in graded sloping terrain.

Decking 24 includes a number of peripheral loop ears 24*a*, each loop ear engaging around a corresponding tubular section 26, 28, of the frame 22 and being locked in a closed loop condition by locking bolts 25, whereby edgewise anchoring of the sheet decking 24 to the frame 22 is achieved. It is understood that, as the length-adjustment means 34 of cross-bar 32 is actuated, the tightness of flexible sheet decking 24 will also be accordingly adjusted. Such tensioning adjustment of the flexible sheet decking 24 will be advantageous to adapt to varying snow density conditions and graded slope terrain.

As illustrated in FIGS. 1–8 of the drawings, a foot harness assembly 36 is mounted over decking 24 and to the intermediate cross-bar 32, directly thereover. Thus, the weight of the wearer will be transmitted through the cross-bar 32 to the frame 22, and distributed over the decking. As suggested in FIGS. 6–8, the harness assembly 36 will be attached to cross-bar 32 by hook members 38 and rotatable around the axis of cross-bar 32 i.e. will be engageable into pitch movement. Harness assembly 36 includes an arcuate, rigid, front toe portion 40, an intermediate, rigid, shoe portion 42, an intermediate strap portion 43 interconnecting the front toe portion 40 and the intermediate shoe portion 42, and a rear, flexible, strap portion 44. Straps 43 and 44 attach around the ankle portion of the leg of a wearer.

Intermediate shoe 42 has a generally ovoidal cross-section but is open at its top portion, as illustrated, and is integrally connected by its flat base wall 42*a* to the front toe portion 40. Flexible rear straps 44, e.g. leather-based, are releasably anchored to the aft end of intermediate shoe 42, e.g. by a pair of quick-release fasteners 46.

Figure 6:
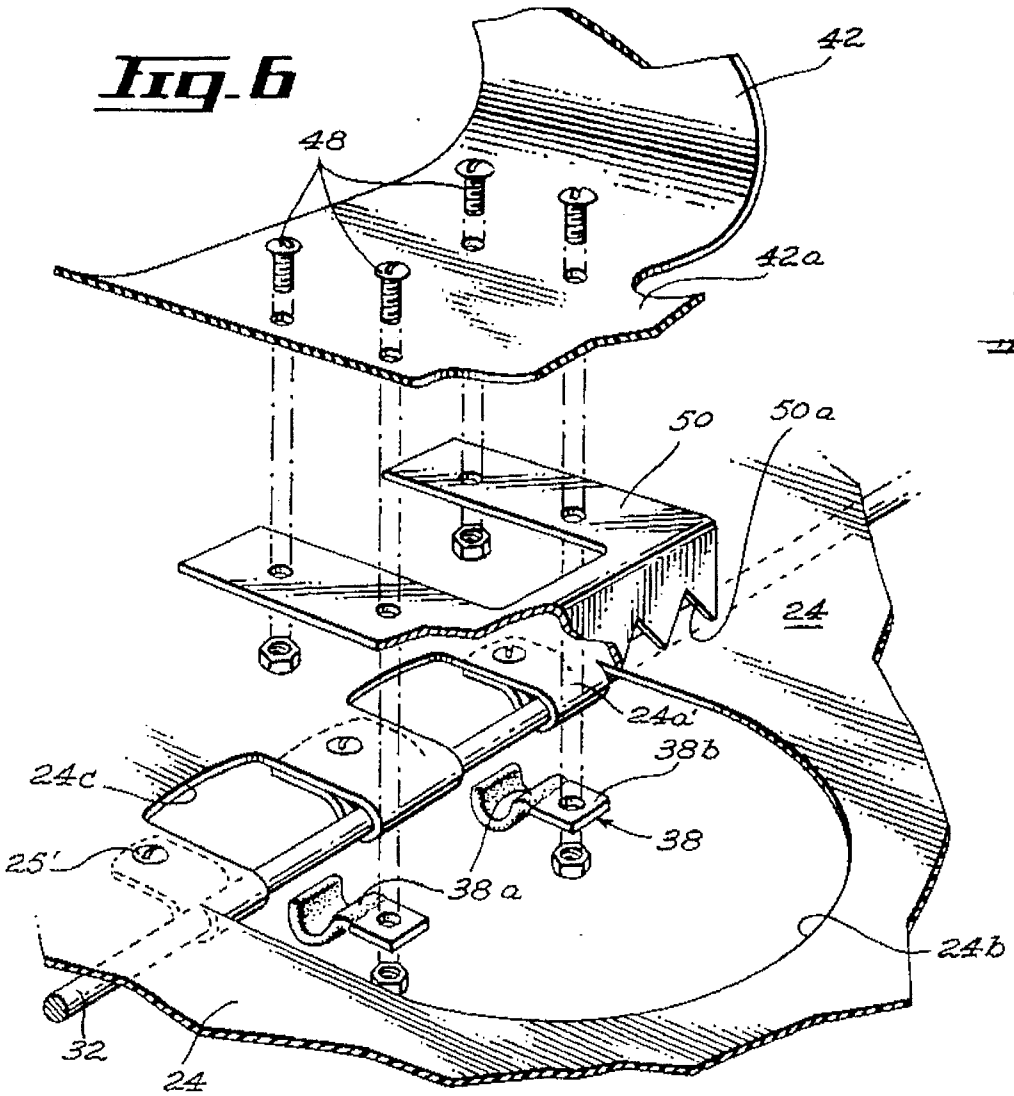
FIG. 6 is an exploded isometric view of some of the harness elements of FIG. 5.

As illustrated in FIG. 6, a U-shape gripper plate 50 is sandwiched between the semi-ovoidal shoe plate 42 and the sheet decking 24. Plates 42 and 50 are interconnected by a number of nut and bolt assemblies 48, with some of the bolts 48 extending through notches 24*c* made into sheet decking 24 rearwardly of cross-bar 32. Sheet decking 24 further includes additional closed loop ears 24*a*', being freely mounted by bolts 25' around cross-bar 32 in register with front sheet aperture 24*b* and adjacent rear sheet notches 24*c*. The front web of gripper plate 50 forms a transverse flange 50*a* having a serrated saw tooth type bottom edge adapted to sink into and bite into packed snow and soft ice.

Each hook member includes a semi-circular channel 38*a* and an edgewise transverse flange 38*b*. Channel 38*a* is sized to rotatably fit around cylindrical cross bar 32, and extends through respective notches 24*c*. Bore flanges 38*b* are fixedly mounted by front bolts 48 to gripper plates 50 and shoe plate 42.

Figure 7:
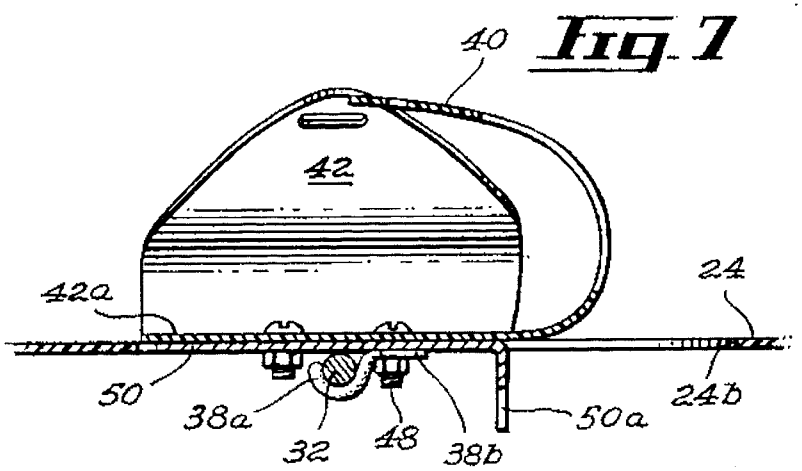
FIGS. 7 and 8 are cross-sectional views taken along broken line VII—VII of FIG. 5, suggesting the lateral tilt play capability of the snowshoe harness relative to the decking.
Figure 8:
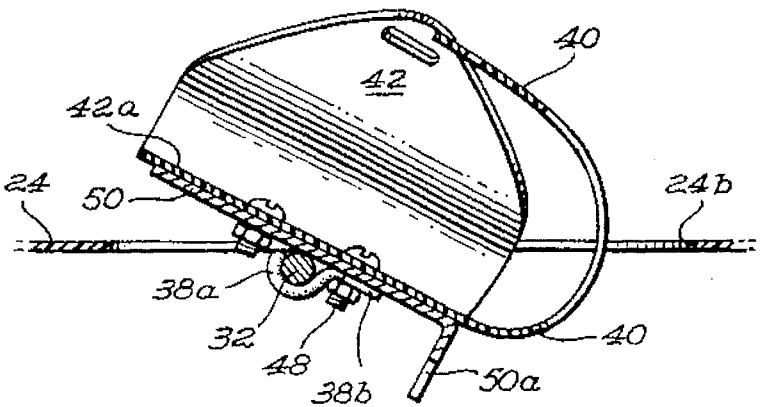

Accordingly, as suggested sequentially in FIGS. 7 and 8, the combination of shoe element 42, of integral toe element 40, and of gripper element 50, is forwardly pivotable with hook elements 38 around pivot shaft 32, from a position overlying sheet decking 24 parallel thereto (FIG. 7), to a forwardly downwardly tilted position (FIG. 8) in which the shoe and toe elements 42 and 40 extend freely through a semicircular front aperture 24*b* of sheet decking 24 (ahead of cross-bar 32) and partially beneath the plane of sheet decking 24. Hence, the load of the wearer's foot inside shoe element 42 remains always distributed to tubular frame 22 via cross bar 32, even during pivotal forward tilt motion thereof around cross-bar 32.

Cross bar 32 (FIGS. 4, 5, 6) is cylindrical and includes a first conical end portion, 32*a*, and an opposite threaded end portion 32*b*. Conical end portion 32*a* engages transversely through an eyelet 33 made into the closed loop ear 24*a* that surrounds connector 30, and into connector member 30, through its radial cavity 30*a*, to come to endwisely abut against the inner end seat of cavity 30*a* at the center of the full connector member 30. Opposite end portion 32*b* engages transversely thorugh an eyelet 33' made into the closed loop ear 24*a* that surrounds connector 31, and a fraction of threaded end portion 32*b* engages threadingly transversely into connector member 31, through its radial threaded channel 31*a*. A nut 52 is threadingly carried by the rod threaded end portion 32*b* exteriorly of channel 31*a*, with nut 52 being located intermediate connectors 30 and 31 and adapted to press eyelet 33' forcibly against connector 1.

It can now be understood that, according to the heart of the invention, as nut 52 is unscrewed against the inner edge of connector 31, the cross-bar 32 will be biased to move axially toward the other connector 30, whereby the two laterally opposite connectors 30 and 31—and the associated respective coaxial legs of U-frame tubes 26, 28—will move away from one another, i.e. the main frame 22 will widen. By widening the main frame 22, the sheet decking 24 (FIG. 4)—which is loosely anchored to the main frame 22 by closed loop ears 24*a*—will progressively tighten. Alternately, by screwing nut 52 along threaded cross-bar portion 32*b*, there is release of the bias that widened the frame 22, so that the sheet decking 24 will release progressively to resume its unbiased loose condition generally illustrated in FIG. 4.

The screwing adjustment of nut 52 can be easily done manually by the wearer himself, simply by bending down and reaching out with his thumb and forefinger to the nut 52 beneath decking 24. The wearer need not release his snowshoe from his foot, during this operation.

Each connector member 30, 31, consists of a cylindrical body 54, 54, respectively, having an intermediate enlarged section 54*a*, 54*a*, through which extend the radial cavity 30*a* or radial channel 31*a*, respectively. On each side of the enlarged cylindrical section 54*a*, there are provided annular outer grooves 54b, 54b, into which are frictionally engaged sealing O-rings 56. These O-rings 56 frictionally engage with the connector inner face 60a, 60b, bounded by the inner lumen thereof, whereby connectors 30, 31, engage therein and interconnect with O-rings 56 in fluid-tight fashion.

The external diameter of cylinder bodies 54—except intermediate enlarged section 54a—is sized to fit inside the lumen of the hollow cylindrical tubings 26 and 28, while the external diameter of each cylinder body intermediate section 54a is sized to correspond to that of tubings 26 and 28, whereby the two facing ends fo each pair of respective tubing legs 26 and 28 will come to abut against the annular seats formed about opposite ends of intermediate connector section 54a.

Frame elements 26, 28, and connectors 30 and 31 should be made from a semi-rigid waterproof material, e.g. galvanized steel or aluminum, i.e. a material being quite rigid yet enabling adjustment of the width of the frame 22 by spreading apart the two sides thereof under bias from tensioning means 32, 31, 30. The O-rings 56 could be made preferably from an elastomeric material. Bolts 25, 48, 48', could be made e.g. from rigid nylon.

I claim:

1. A snowshoe comprising:

(a) a semi-rigid, open, main frame, defining a main inner open area;

(b) a flexible sheet decking, extending over said open frame main inner open area, and defining a peripheral edge section;

(c) means for attaching the peripheral edge section of said sheet decking to said main frame; and (d) means for adjustably varying the tensioning of said flexible sheet decking; whereby said sheet decking is adapted to receive and support a wearer's foot;

wherein said tension adjusting means includes an elongated telescopic member, extending through said main open area and connected at opposite ends to said main frame, wherein said telescopic member adjustably deforms the shape of said flexible sheet decking whereby variations in tensioning thereof follows;

wherein said open frame consists of a tubular member, disposed in an ovoidal closed loop fashion; and said adjustment means includes:

a rigid elongated cross-bar member, extending transversely of said main open area at an intermediate section of said main frame;

means for mounting each end portion of the cross-bar member to transversely opposite sections of said frame tubular member; and telescopic means for varying the length of said cross-bar member wherein said frame tubular member includes two generally U-shaped half-sections, and a pair of first and second tubular connector members releasably interconnecting the outer ends of each pair of coxially registering legs of said two half-sections of the frame tubular member; said mounting means including a radial cavity in said first connector member, being fully engaged by a first end portion of said cross-bar member, and a radial channel in said second connector member, being at least partially engaged by a second end portion of said cross-bar member.

2. A snowshoe as defined in claim 1, wherein said telescopic means includes the provision of inner threads, made into said second connector member radial channel, outer threads, made in said second end portion of the cross-bar member, and a nut member, threadingly carried by the threaded portion of said cross-bar member intermediately of said first and second connector members; whereby unscrewing action unto said nut member against the registering tubular section of said open frame spreads apart the opposite intermediate tubular sections of said open frame and increases the width of said open frame, thus tightening the tensioning of said sheet decking.

3. A showshoe as defined in claim 1, wherein said sheet decking is made from neoprene.

4. A snowshoe as defined in claim 1, wherein each said tubular connector member includes an intermediate diametrally enlarged section, into which the radial cavity and the radial channel are respectively lodged, and two opposite tubular segments, each tubular segment having an intermediate annular groove, a sealing O-ring being lodged into each said groove, each said O-ring frictionally engaging with the interior face of the corresponding tubular leg of the open frame in fluid-tight fashion.

5. A snowshoe as defined in claim 1, wherein said peripheral attachment means consists of a number of discrete ear loop members, integrally carried at the peripheral edge portion of said sheet decking and anchored to the main tubular frame by bolt members, successive said ear loop members being spaced from each other.

6. A snowshoe comprising:

(a) a semi-rigid, open, main frame, defining a main inner open area;

(b) a flexible sheet decking, extending over said open frame main inner open area, and defining a peripheral edge section;

(c) means for attaching the peripheral edge section of said sheet decking to said main frame; and (d) means for adjustably varying the tensioning of said flexible sheet decking; whereby said sheet decking is adapted to receive and support a wearer's foot;

wherein said tension adjusting means includes an elongated telescopic member, extending through said main open area and connected at opposite ends to said main frame, wherein said telescopic member adjustbly deforms the shape of said flexible sheet decking whereby variations in tensioning thereof follows;

wherein said open frame consists of a tubular member, disposed in an ovoidal closed loop fashion; and said adjustment means includes:

a rigid elongated cross-bar member, extending transversely of said main open area at an intermediate section of said main frame;

means for mounting each end portion of the cross-bar member to transversely opposite sections of said frame tubular member; and telescopic means for varying the length of said cross-bar member further including a harness assembly, having a rigid base part and a flexible strap part, and hook members pivotally interconnecting said rigid base part to said rigid cross-bar member for pitch motion control of wearer, said rigid base part for containing the toe portion of the wearer's foot and said strap part for attachment to the wearer's ankle portion.

7. A snowshoe as defined in claim 6, further including a large aperture, made into said sheet decking ahead of said harness base part and sized for free partial through-engagement by said harness base part and associated wearer's foot, and a rigid gripper member, carried transversely of said harness base part, said gripper member defining a serrated edge for forcible engagement into frozen ground terrain upon forward pitch motion of said harness base part.

* * * * *